US011473816B2

(12) United States Patent
Nagamatsu et al.

(10) Patent No.: US 11,473,816 B2
(45) Date of Patent: Oct. 18, 2022

(54) AIR CONDITIONER

(71) Applicant: Samsung Electronics Co., Ltd., Suwon-si (KR)

(72) Inventors: Shinichiro Nagamatsu, Yokohama (JP); Tetsuya Ogasawara, Yokohama (JP); Nozomu Inoue, Yokohama (JP); Hisashi Takeichi, Yokohama (JP)

(73) Assignee: Samsung Electronics Co., Ltd., Suwon-si (KR)

( * ) Notice: Subject to any disclaimer, the term of this patent is extended or adjusted under 35 U.S.C. 154(b) by 112 days.

(21) Appl. No.: 16/726,082

(22) Filed: Dec. 23, 2019

(65) Prior Publication Data

US 2020/0200441 A1 Jun. 25, 2020

(30) Foreign Application Priority Data

Dec. 21, 2018 (JP) ..... JP2018-239854
Nov. 15, 2019 (KR) ..... 10-2019-0146368

(51) Int. Cl.
*F25B 13/00* (2006.01)

(52) U.S. Cl.
CPC ..... *F25B 13/00* (2013.01); *F25B 2313/0272* (2013.01); *F25B 2500/23* (2013.01)

(58) Field of Classification Search
CPC ..... F25B 13/00; F25B 2313/0272; F25B 2500/23; F25B 2400/0411; F25B 2313/02741; F25B 2400/13; F25B 2313/0233
See application file for complete search history.

(56) References Cited

U.S. PATENT DOCUMENTS 6,615,597 B1 9/2003 Domyo et al.
2008/0060365 A1* 3/2008 Sakitani ..... F25B 40/00 62/114

(Continued)

FOREIGN PATENT DOCUMENTS

EP 1033541 A1 9/2000
EP 2230473 A1 9/2010

(Continued)

OTHER PUBLICATIONS

Hirao et al., Air Conditioner, Jan. 22, 1999, JPH1114165A, Whole Document (Year: 1999).*

(Continued)

*Primary Examiner* — Larry L Furdge

(57) ABSTRACT

An air conditioner including a refrigerant circuit including a compressor, an outdoor heat exchanger, an outdoor expansion valve, an indoor expansion valve, and an indoor heat exchanger. The refrigerant circuit including an auxiliary heat exchanger provided on a refrigerant pipe between the outdoor heat exchanger and the indoor expansion valve and connected in series with the outdoor expansion valve, and a rectifier configured to allow a refrigerant flowing from the outdoor heat exchanger toward the indoor expansion valve in a cooling operation or a refrigerant flowing from the indoor expansion valve toward the outdoor heat exchanger in a heating operation to sequentially flow through the auxiliary heat exchanger and the outdoor expansion valve.

17 Claims, 5 Drawing Sheets

(56) References Cited

U.S. PATENT DOCUMENTS

| | | | | |
|---|---|---|---|---|
| 2015/0143841 | A1* | 5/2015 | Kawano | F25B 1/005 62/498 |
| 2015/0176848 | A1 | 6/2015 | Jung et al. | |
| 2016/0370039 | A1 | 12/2016 | Kawano et al. | |
| 2017/0336120 | A1 | 11/2017 | Kawano et al. | |
| 2018/0372379 | A1 | 12/2018 | Kamitani et al. | |
| 2020/0355419 | A1* | 11/2020 | Tomiyama | F25B 6/04 |

FOREIGN PATENT DOCUMENTS

| | | | | |
|---|---|---|---|---|
| EP | 3339765 | A1 | | 6/2018 |
| EP | 3364128 | A1 | | 8/2018 |
| JP | H03217771 | A | * | 9/1991 |
| JP | h10132410 | A | * | 5/1998 |
| JP | H1114165 | A | * | 1/1999 |
| JP | H11-118266 | A | | 4/1999 |
| JP | 3440910 | B2 | | 8/2003 |
| JP | 2007-263444 | A | | 10/2007 |
| JP | 2009-127902 | A | | 6/2009 |
| JP | 2009-229055 | A | | 10/2009 |
| JP | 2010014351 | A | * | 1/2010 |
| JP | 2010-112657 | A | | 5/2010 |
| JP | 2017-009155 | A | | 1/2017 |
| KR | 10-1901540 | B1 | | 9/2018 |

OTHER PUBLICATIONS

Oshitto, Refrigerating Air Conditioner, Jan. 21, 2010, JP2010014351A, Whole Document (Year: 2010).*

Imada et al., Air Conditioner, May 22, 1998, JPH10132410A, Whole Document (Year: 1998).*

Sekigami et al., Air Conditioner, Sep. 25, 1991, JPH03217771A, Whole Document (Year: 1991).*

International Search Report dated Apr. 22, 2020 in connection with International Patent Application No. PCT/KR2019/018333, 3 pages.

Supplementary European Search Report dated Nov. 19, 2021, in connection with European Application No. 19899217.4, 13 pages.

Supplementary European Search Report dated Feb. 21, 2022, in connection with European Application No. 19899217.4, 11 pages.

* cited by examiner

AIR CONDITIONER

CROSS-REFERENCE TO RELATED APPLICATIONS

This application is based on and claims priority under 35 U.S.C. 119 to Korean Patent Application No 10-2019-0146368, filed on Nov. 15, 2019, in the Korean Intellectual Property Office, which claims the benefit of Japanese Patent Application No. 2018-239854 filed on Dec. 21, 2018, in the Japan Patent Office, the disclosures of which are herein incorporated by reference in their entireties

BACKGROUND

1. Field

The disclosure relates to an air conditioner.

2. Description of Related Art

In general, an air conditioner includes an outdoor unit including a compressor and an outdoor heat exchanger, an indoor unit including an indoor expansion valve and an indoor heat exchanger, and a refrigerant circuit connecting the above components to each other through a refrigerant liquid pipe and a refrigerant gas pipe. The air conditioner circulates the refrigerant filled in the refrigerant circuit through the compressor, the outdoor heat exchanger, the refrigerant liquid pipe, the indoor expansion valve, the indoor heat exchanger, the refrigerant gas pipe, and the compressor in order.

Recently, as regulations on HFC refrigerants have become a reality with the adoption of the Kigali Revision Protocol, the use of HFC refrigerants is decreasing worldwide and the price of refrigerants such as R410A is rising. Due to this background, in recent years, a technology for reducing the amount of refrigerant charged into the refrigerant circuit has been applied to an air conditioner.

Japanese Unexamined Patent Publication No. 2017-009155 discloses an air conditioner capable of reducing the amount of refrigerant charged into a refrigerant circuit. This air conditioner reduces the amount of refrigerant used as an outdoor expansion valve is provided between an auxiliary heat exchanger provided in the outdoor unit and the indoor heat exchanger so that the refrigerant in the refrigerant liquid pipe connecting the indoor unit and the outdoor unit is in a state where gas and liquid are mixed. In a cooling operation, the refrigerant passes through the auxiliary heat exchanger and is then depressurized in the outdoor expansion valve, thereby being in a state where gas and liquid are mixed. Also, in a heating operation, the refrigerant passes through the indoor heat exchanger and is then depressurized in the indoor expansion valve, thereby being in a state where gas and liquid are mixed.

However, because in such an air conditioner, the refrigerant in a state where gas and liquid are mixed in the heating operation is depressurized by the outdoor expansion valve provided upstream of the auxiliary heat exchanger, the heat exchange rate of the refrigerant in the auxiliary heat exchanger is lowered, so that the performance of the auxiliary heat exchanger is lowered as compared with the case where a refrigerant of a liquid state flows.

SUMMARY

It is an aspect of the disclosure to provide an air conditioner capable of reducing the amount of refrigerant flowing through a refrigerant circuit and preventing the performance of an auxiliary heat exchanger from being lowered in a cooling operation and a heating operation.

Additional aspects of the disclosure will be set forth in part in the description which follows and, in part, will be obvious from the description, or may be learned by practice of the disclosure.

In accordance with an aspect of the disclosure, an air conditioner includes a refrigerant circuit including a compressor, an outdoor heat exchanger, an outdoor expansion valve, an indoor expansion valve, and an indoor heat exchanger, wherein the refrigerant circuit includes an auxiliary heat exchanger provided on a refrigerant pipe between the outdoor heat exchanger and the indoor expansion valve and connected in series with the outdoor expansion valve, and a rectifier configured to allow a refrigerant flowing from the outdoor heat exchanger toward the indoor expansion valve in a cooling operation or a refrigerant flowing from the indoor expansion valve toward the outdoor heat exchanger in a heating operation to sequentially flow through the auxiliary heat exchanger and the outdoor expansion valve.

A refrigerant flowing between the indoor expansion valve and the outdoor expansion valve may be mixed in a gaseous state and a liquid state.

The rectifier, in the cooling operation, may allow the refrigerant passed through the outdoor expansion valve to flow to the indoor expansion valve and the refrigerant passed through the outdoor heat exchanger flow to the auxiliary heat exchanger, and in the heating operation, may allow the refrigerant passed through the indoor expansion valve to flow to the auxiliary heat exchanger and the refrigerant passed through the outdoor expansion valve flow to the outdoor heat exchanger.

The rectifier may include a first check valve to allow only a flow of the refrigerant from the indoor expansion valve toward the auxiliary heat exchanger in the heating operation, a second check valve to allow only a flow of the refrigerant from the outdoor expansion valve toward the outdoor heat exchanger in the heating operation, a third check valve to allow only a flow of the refrigerant from the outdoor heat exchanger toward the auxiliary heat exchanger in the cooling operation, and a fourth check valve to allow only a flow of the refrigerant from the outdoor expansion valve toward the indoor expansion valve in the cooling operation.

The air conditioner may further include at least one bypass passage bypassing the outdoor expansion valve, and at least one flow regulating valve installed on the at least one bypass passage.

The air conditioner may further include an injection passage to allow a part of the refrigerant flowing from the auxiliary heat exchanger to the outdoor expansion valve to flow to the compressor through the auxiliary heat exchanger, and a supercooling expansion valve to expand the refrigerant in the injection passage flowing toward the auxiliary heat exchanger.

In accordance with another aspect of the disclosure, an air conditioner includes a refrigerant circuit including a compressor, an outdoor heat exchanger, an outdoor expansion valve, an indoor expansion valve, and an indoor heat exchanger, wherein the outdoor expansion valve includes a first outdoor expansion valve and a second outdoor expansion valve sequentially installed on a refrigerant pipe from the outdoor heat exchanger toward the indoor expansion valve, and wherein the refrigerant circuit further includes an auxiliary heat exchanger provided on a refrigerant pipe between the first outdoor expansion valve and the second outdoor expansion valve, at least one first bypass passage bypassing the first outdoor expansion valve, at least one first flow regulating valve installed on the at least one first bypass passage, at least one second bypass passage bypassing the second outdoor expansion valve, and at least one second flow regulating valve installed on the at least one second bypass passage.

The first flow regulating valve may be opened in the cooling operation, and the second flow regulating valve may be opened in the heating operation.

The air conditioner may further include a check valve installed on the first bypass passage to allow only a flow of the refrigerant from the outdoor heat exchanger toward the auxiliary heat exchanger, and a check valve installed on the second bypass passage to allow only a flow of the refrigerant from the indoor heat exchanger toward the auxiliary heat exchanger.

The refrigerant flowing between the second outdoor expansion valve and the indoor expansion valve may be mixed in a gaseous state and a liquid state.

The air conditioner may further include an injection passage to allow a part of the refrigerant flowing from the auxiliary heat exchanger to the second outdoor expansion valve to flow to the compressor through the auxiliary heat exchanger, and a supercooling expansion valve to expand the refrigerant in the injection passage flowing toward the auxiliary heat exchanger.

In accordance with another aspect of the disclosure, an air conditioner includes a refrigerant circuit including a compressor, an outdoor heat exchanger, an outdoor expansion valve, an indoor expansion valve, and an indoor heat exchanger, wherein the refrigerant circuit includes an auxiliary heat exchanger provided on a refrigerant pipe between the outdoor heat exchanger and the indoor expansion valve and connected in series with the outdoor expansion valve, and a passage changer configured to change passages such that a refrigerant flowing from the outdoor heat exchanger toward the indoor expansion valve in a cooling operation or a refrigerant flowing from the indoor expansion valve toward the outdoor heat exchanger in a heating operation sequentially passes through the auxiliary heat exchanger and the outdoor expansion valve.

Before undertaking the DETAILED DESCRIPTION below, it may be advantageous to set forth definitions of certain words and phrases used throughout this patent document: the terms "include" and "comprise," as well as derivatives thereof, mean inclusion without limitation; the term "or," is inclusive, meaning and/or, the phrases "associated with" and "associated therewith," as well as derivatives thereof, may mean to include, be included within, interconnect with, contain, be contained within, connect to or with, couple to or with, be communicable with, cooperate with, interleave, juxtapose, be proximate to, be bound to or with, have, have a property of, or the like; and the term "controller" means any device, system or part thereof that controls at least one operation, such a device may be implemented in hardware, firmware or software, or some combination of at least two of the same. It should be noted that the functionality associated with any particular controller may be centralized or distributed, whether locally or remotely.

Definitions for certain words and phrases are provided throughout this patent document, those of ordinary skill in the art should understand that in many, if not most instances, such definitions apply to prior, as well as future uses of such defined words and phrases.

BRIEF DESCRIPTION OF THE DRAWINGS

These and/or other aspects of the disclosure will become apparent and more readily appreciated from the following description of the embodiments, taken in conjunction with the accompanying drawings of which.

DETAILED DESCRIPTION

FIGS. 1 through 5, discussed below, and the various embodiments used to describe the principles of the present disclosure in this patent document are by way of illustration only and should not be construed in any way to limit the scope of the disclosure. Those skilled in the art will understand that the principles of the present disclosure may be implemented in any suitably arranged system or device.

Hereinafter an air conditioner according to embodiments of the disclosure will be described in detail with reference to the accompanying drawings.

Figure 1:
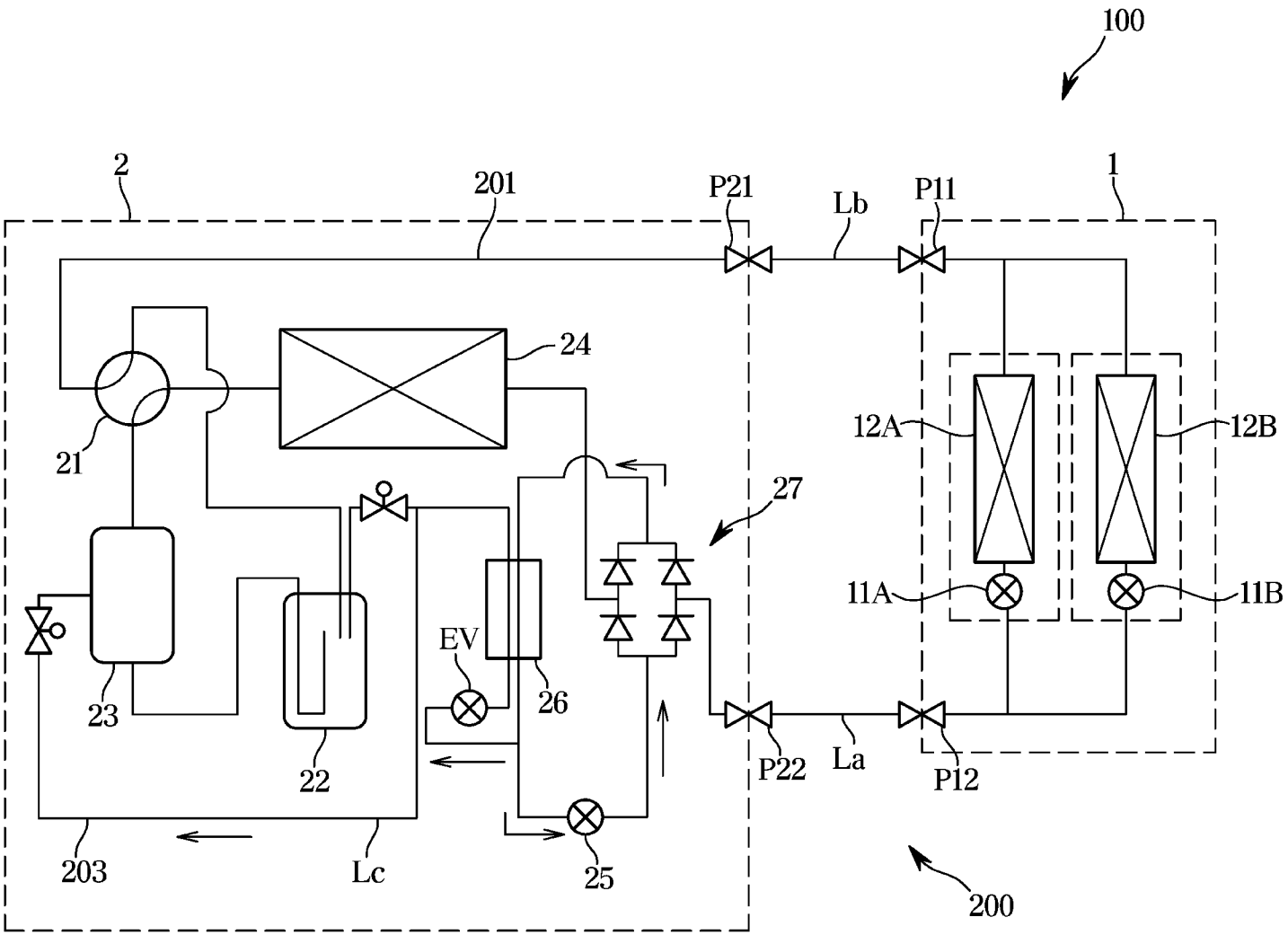
FIG. 1 illustrates a refrigerant circuit of an air conditioner according to a first embodiment of the disclosure.

Referring to FIG. 1, an air conditioner 100 according to a first embodiment of the disclosure, includes an indoor unit 1 installed on the inside of a structure, an outdoor unit 2 installed on the outside of the structure, and a refrigerant circuit 200 (heat pump cycle) to allow a refrigerant to flow to the indoor unit 1 and the outdoor unit 2.

The air conditioner 100 may be applied to a large structure such as a building. The indoor unit 1 and the outdoor unit 2 may be disposed at the inside and outside of a structure, respectively, and then may be connected by a refrigerant gas pipe Lb and a refrigerant liquid pipe La which are installed at a site. Therefore, the amount of refrigerant charged in the refrigerant circuit 200 may increase according to the installation environment.

In a cooling operation or a heating operation of the air conditioner 100 according to the first embodiment, the refrigerant passed through the refrigerant liquid pipe La may be in a state where gas and liquid are mixed. Therefore, the amount of the refrigerant passing through the refrigerant liquid pipe La may be reduced as compared with the case of flowing in the liquid state.

The indoor unit 1 may include indoor expansion valves 11A and 11B connected in parallel to each other, and indoor heat exchangers 12A and 12B connected in series to the indoor expansion valves 11A and 11B, respectively.

The outdoor unit 2 may include a four-way valve 21, an accumulator 22, a compressor 23, an outdoor heat exchanger 24, an outdoor expansion valve 25, an auxiliary heat exchanger 26, and a rectifier 27 to rectify a flow of the refrigerant in a predetermined direction.

The refrigerant circuit 200 may switch the cooling operation and the heating operation as the passage connection is changed by the operation of the four-way valve 21. The refrigerant circuit 200 may include a main circuit 201 in which the indoor expansion valves 11A and 11B, the indoor heat exchangers 12A and 12B, the four-way valve 21, the accumulator 22, the compressor 23, the outdoor heat exchanger 24, the rectifier 27, the auxiliary heat exchanger 26, and the outdoor expansion valve 25 are connected.

The indoor unit 1 and the outdoor unit 2 are connected by the refrigerant gas pipe Lb and the refrigerant liquid pipe La. In the refrigerant gas pipe Lb, a gaseous refrigerant or a gas-liquid mixed refrigerant close to a gaseous state may flow. In the refrigerant liquid pipe La, a gaseous refrigerant and a liquid refrigerant may flow together. The refrigerant gas pipe Lb and the refrigerant liquid pipe La are connected to connection portions P11 and P12 of the indoor unit 1 and connection portions P21 and P22 of the outdoor unit 2 at a site where the air conditioner is installed.

In the main circuit 201, one ends of the indoor heat exchangers 12A and 12B are connected to the indoor expansion valves 11A and 11B, respectively, and the other ends of the indoor heat exchangers 12A and 12B may be connected to the accumulator 22 through the refrigerant gas pipe Lb and the four-way valve 21.

One end of the compressor 23 may be connected to the accumulator 22, and the other end of the compressor 23 may be connected to the outdoor heat exchanger 24 through the four-way valve 21. One end of the outdoor heat exchanger 24 may be connected to the four-way valve 21, and the other end of the outdoor heat exchanger 24 may be connected to the rectifier 27.

One end of the auxiliary heat exchanger 26 is connected to the rectifier 27, and the other end of the auxiliary heat exchanger 26 is connected to the outdoor expansion valve 25. One end of the outdoor expansion valve 25 is connected to the auxiliary heat exchanger 26, and the other end of the outdoor expansion valve 25 is connected to the rectifier 27. One ends of the indoor expansion valves 11A and 11B are connected to the rectifier 27 through the refrigerant liquid pipe La, and the other ends of the indoor expansion valves 11A and 11B are connected to the indoor heat exchangers 12A and 12B, respectively.

The refrigerant circuit 200 further includes an injection passage 203 to branch a part of the refrigerant flowing from the auxiliary heat exchanger 26 toward the outdoor expansion valve 25 from the main circuit 201 to flow to the compressor 23.

The injection passage 203 may be implemented by an injection pipe Lc, one end of which is connected to an injection inlet of the compressor 23 and the other end of which is connected to a refrigerant pipe between the auxiliary heat exchanger 26 and the outdoor expansion valve 25. The injection passage 203 passes through the auxiliary heat exchanger 26 to allow the refrigerant flowing therein to exchange heat with the auxiliary heat exchanger 26. The auxiliary heat exchanger 26 may be installed such that the main circuit 201 and the injection passage 203 pass therethrough.

A supercooling expansion valve EV is installed on the injection passage 203 upstream of the auxiliary heat exchanger 26. The supercooling expansion valve EV expands the refrigerant in the injection passage 203 flowing toward the auxiliary heat exchanger 26 to cool the auxiliary heat exchanger 26. Accordingly, the auxiliary heat exchanger 26 may cool the refrigerant flowing through the main circuit 201.

In the refrigerant circuit 200, the indoor heat exchangers 12A and 12B heat-exchange indoor air with the refrigerant flowing therein, and the outdoor heat exchanger 24 heat-exchanges the refrigerant flowing therein with outdoor air. The indoor expansion valves 11A and 11B, the outdoor expansion valve 25, and the supercooling expansion valve EV may be motorized valves to adjust an opening degree of a passage to expand and decompress the refrigerant passing through the passage.

In the cooling operation, the rectifier 27 allows the refrigerant flowing from the outdoor heat exchanger 24 toward the indoor expansion valves 11A and 11B to flow through the auxiliary heat exchanger 26 and the outdoor expansion valve 25 sequentially.

In the heating operation, the rectifier 27 allows the refrigerant flowing from the indoor expansion valves 11A and 11B toward the outdoor heat exchanger 24 to flow through the auxiliary heat exchanger 26 and the outdoor expansion valve 25 sequentially.

Figure 2:
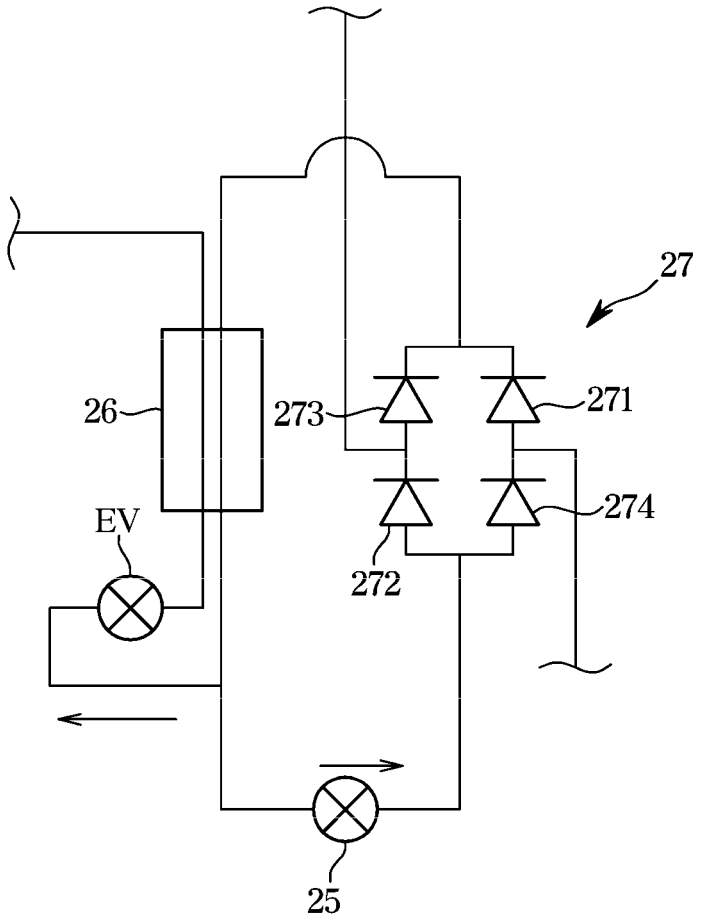
FIG. 2 illustrates a rectifier of the air conditioner according to the first embodiment of the disclosure.

That is, rectifier 27 operates as a flow controller for controlling the refrigerant flowing between the outdoor heat exchanger 24 and the indoor expansion valves 11A and 11*b* to flow only in a direction from the auxiliary heat exchanger 26 toward the outdoor expansion valve 25 regardless of an operating state of the air conditioner. The rectifier 27 includes first to fourth check valves 271, 272, 273 and 274 and pipes in the form of a bridge circuit to connect the check valves 271, 272, 273 and 274, as illustrated in FIG. 2.

The first check valve 271 allows only a flow of the refrigerant from the indoor expansion valves 11A and 11B toward the auxiliary heat exchanger 26 in the heating operation. The second check valve 272 allows only a flow of the refrigerant from the outdoor expansion valve 25 toward the outdoor heat exchanger 24 in the heating operation. The third check valve 273 allows only a flow of the refrigerant from the outdoor heat exchanger 24 toward the auxiliary heat exchanger 26 in the cooling operation. The fourth check valve 274 allows only a flow of the refrigerant from the outdoor expansion valve 25 toward the indoor expansion valves 11A and 11B in the cooling operation.

The operation during the cooling operation and the operation during the heating operation of the air conditioner 100 according to the first embodiment will be described below.

In the cooling operation, the refrigerant charged in the refrigerant circuit 200 circulates through the compressor 23, the outdoor heat exchanger 24, the third check valve 273, the auxiliary heat exchanger 26, the outdoor expansion valve 25, the fourth check valve 274, the refrigerant liquid pipe La, the indoor expansion valves 11A and 11B, the indoor heat exchangers 12A and 12B, the refrigerant gas pipe Lb, the accumulator 22, and the compressor 23 in order.

The refrigerant in in a high-temperature gaseous state delivered from the compressor 23 is liquefied through heat exchange with the outdoor air of low temperature in the outdoor heat exchanger 24. Thereafter, the liquefied refrigerant flows through the third check valve 273 of the rectifier 27 to the auxiliary heat exchanger 26 and then is cooled through heat exchange with the refrigerant flowing through the injection passage 203 while passing through the auxiliary heat exchanger 26.

The refrigerant in a liquid state passed through the auxiliary heat exchanger 26 is depressurized and expanded while passing through the outdoor expansion valve 25 and flows to the rectifier 27 in a state where gas and liquid are mixed. Thereafter, the refrigerant flows to the indoor unit through the fourth check valve 274 of the rectifier 27 and the refrigerant liquid pipe La.

In the cooling operation, because the refrigerant flowing from the outdoor expansion valve 25 to the rectifier 27 during the cooling operation has a lower pressure than the refrigerant at an outlet side of the outdoor heat exchanger 24, the refrigerant flows to the fourth check valve 274 without flowing toward the second check valve 272, and the refrigerant passed through the fourth check valve 274 flows to the refrigerant liquid pipe La without flowing toward the first check valve 271 according to the same principle.

The refrigerant introduced into the indoor unit 1 through the refrigerant liquid pipe La is cooled by being further depressurized in the indoor expansion valves 11A and 11B and then evaporated by heat exchange with the indoor air in the indoor heat exchangers 12A and 12B. The refrigerant in a gaseous state (strictly close to gas but mixed with gas and liquid) passed through the indoor heat exchangers 12A and 12B flows to the outdoor unit 2 through the refrigerant gas pipe Lb and then is sucked into the compressor 23 after passing through the accumulator 22.

In the cooling operation, the rectifier 27 allows the refrigerant passed through the outdoor heat exchanger 24 to flow to the auxiliary heat exchanger 26 and allows the refrigerant passed through the outdoor expansion valve 25 to flow to the indoor expansion valves 11A and 11B. Accordingly, the refrigerant delivered from the outdoor heat exchanger 24 passes through the auxiliary heat exchanger 26 and the outdoor expansion valve 25 in order and then flows to the indoor expansion valves 11A and 11B.

In the heating operation, the refrigerant charged in the refrigerant circuit 200 circulates through the compressor 23, the refrigerant gas pipe Lb, the indoor heat exchangers 12A and 12B, the indoor expansion valves 11A and 11B, the refrigerant liquid pipe La, the first check valve 271, the auxiliary heat exchanger 26, the outdoor expansion valve 25, the second check valve 272, the outdoor heat exchanger 24, the accumulator 22, and the compressor 23 in order.

The refrigerant in a high-temperature gaseous state delivered from the compressor 23 flows to the indoor heat exchangers 12A and 12B through the refrigerant gas pipe Lb and is liquefied by heat exchange with the indoor air in the heat exchangers 12A and 12B. The refrigerant in a liquid state passed through the indoor heat exchangers 12A and 12B is depressurized and expanded in the indoor expansion valves 11A and 11B and then flows to the outdoor unit 2 through the refrigerant liquid pipe La in a state where gas and liquid are mixed.

Thereafter, the refrigerant flows to the auxiliary heat exchanger 26 through the first check valve 271 of the rectifier 27 and then is cooled by heat exchange with the refrigerant flowing through the injection passage 203 in the auxiliary heat exchanger 26. The gas-liquid mixed refrigerant passed through the auxiliary heat exchanger 26 is further depressurized and cooled in the outdoor expansion valve 25 and then flows to the outdoor heat exchanger 24 through the second check valve 272 of the rectifier 27.

In the heating operation, because the refrigerant flowing from the outdoor expansion valve 25 to the rectifier 27 has a lower pressure than the refrigerant at outlet sides of the indoor expansion valves 11A and 11B, the refrigerant flows to the second check valve 272 without flowing toward the fourth check valve 274, and the refrigerant passed through the second check valve 272 flows to the outdoor heat exchanger 24 without flowing toward the third check valve 273 according to the same principle.

The gas-liquid mixed refrigerant is heated by heat exchange with a high-temperature outdoor air in the outdoor heat exchanger 24 and then sucked into the compressor 23 through the accumulator 22.

In the heating operation, the rectifier 27 allows the refrigerant passed through the indoor expansion valves 11A and 11B to flow to the auxiliary heat exchanger 26 and allows the refrigerant passed through the outdoor expansion valve 25 to flow to the outdoor heat exchanger 24. Accordingly, the gas-liquid mixed refrigerant delivered from the indoor expansion valves 11A and 11B passes through the auxiliary heat exchanger 26 and the outdoor expansion valve 25 in order and then flows to the outdoor heat exchanger 24.

The air conditioner 100 according to the first embodiment may reduce the amount of refrigerant flowing through the refrigerant circuit 200, and may prevent a decrease in operating efficiency in both the cooling operation and the heating operation.

Specifically, the air conditioner 100 according to the first embodiment may reduce the amount of refrigerant charged in the refrigerant circuit 200 because the refrigerant flowing through the refrigerant liquid pipe La between the outdoor unit 2 and the indoor unit 1 is maintained in a state where gas and liquid are mixed (two-phase state). In addition, the air conditioner 100 according to the first embodiment may suppress the lowering of the performance of the auxiliary heat exchanger 26 in both the cooling operation and the heating operation because the rectifier 27 rectifies the refrigerant to flow only in a direction from the auxiliary heat exchanger 26 toward the outdoor expansion valve 25 in both the cooling operation and the heating operation.

In the cooling operation, because the refrigerant passing through the auxiliary heat exchanger 26 is maintained in a liquid state having a high density, the performance of the auxiliary heat exchanger 26 may be sufficiently exhibited. In the heating operation, because the refrigerant flowing from the indoor unit 1 to the outdoor unit 2 also flows toward the outdoor expansion valve 25 after passing through the auxiliary heat exchanger 26, the performance of the auxiliary heat exchanger 26 may be sufficiently exhibited.

Figure 3:
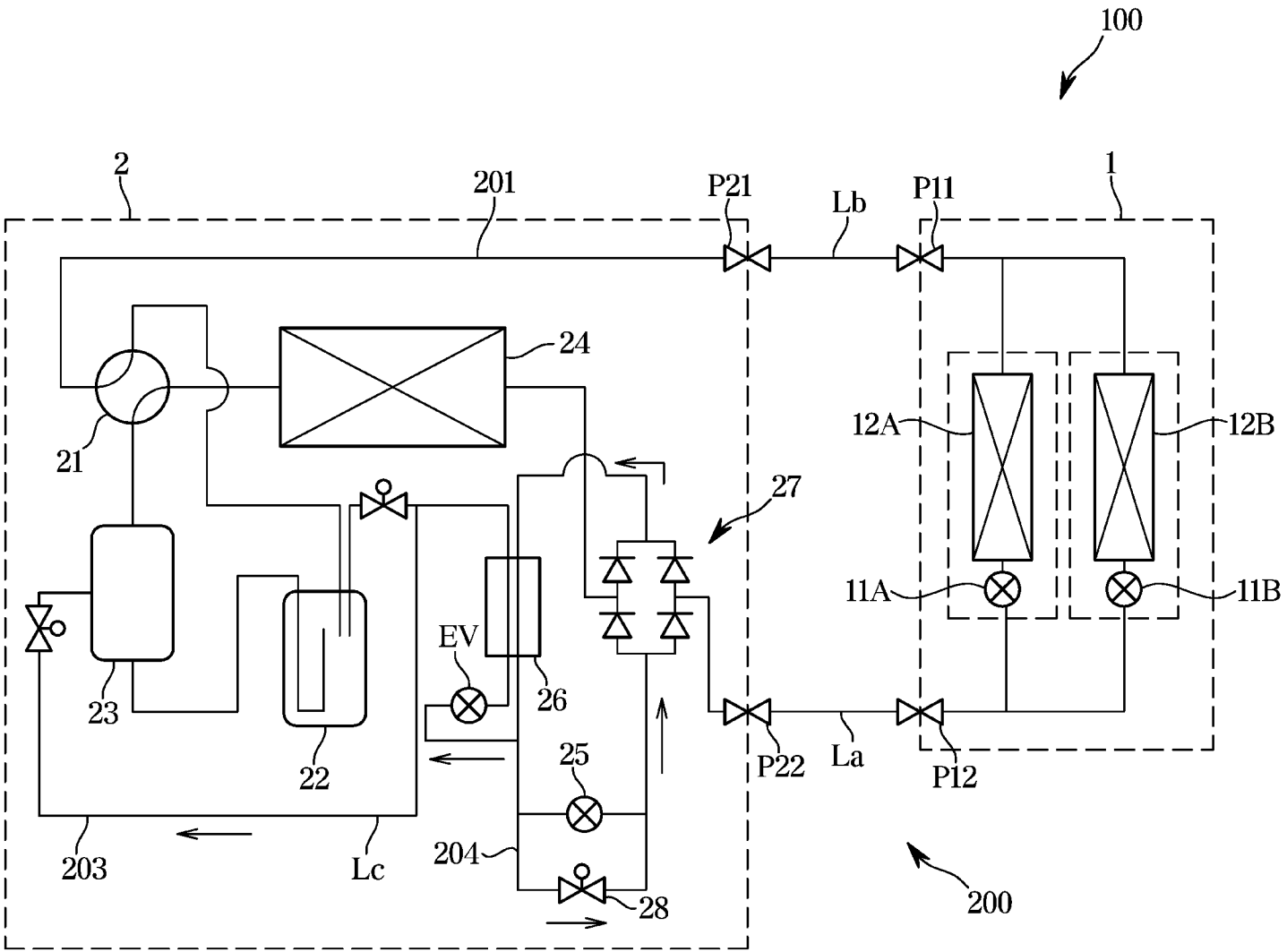
FIG. 3 illustrates a refrigerant circuit of an air conditioner according to a second embodiment of the disclosure.

FIG. 3 illustrates a refrigerant circuit of an air conditioner according to a second embodiment.

The air conditioner according to the second embodiment further includes one or more bypass passages 204 bypassing the outdoor expansion valve 25 and one or more flow regulating valves 28 installed on the one or more bypass passages 204. One end of the bypass passage 204 is connected to an upstream side of the outdoor expansion valve 25 and the other end of the bypass passage 204 is connected to a downstream side of the outdoor expansion valve 25. The flow regulating valve 28 may be a motorized valve and is connected in parallel with the outdoor expansion valve 25.

When proper heating degree control of the outdoor heat exchanger 24 is not possible in an opening degree range of the outdoor expansion valve 25 in the heating operation, the air conditioner of the second embodiment may increase an opening degree of the flow regulating valve 28 to reduce a flow rate of the refrigerant passing through the outdoor expansion valve 25, thereby properly adjusting the heating degree in the outdoor heat exchanger 24.

Figure 4:
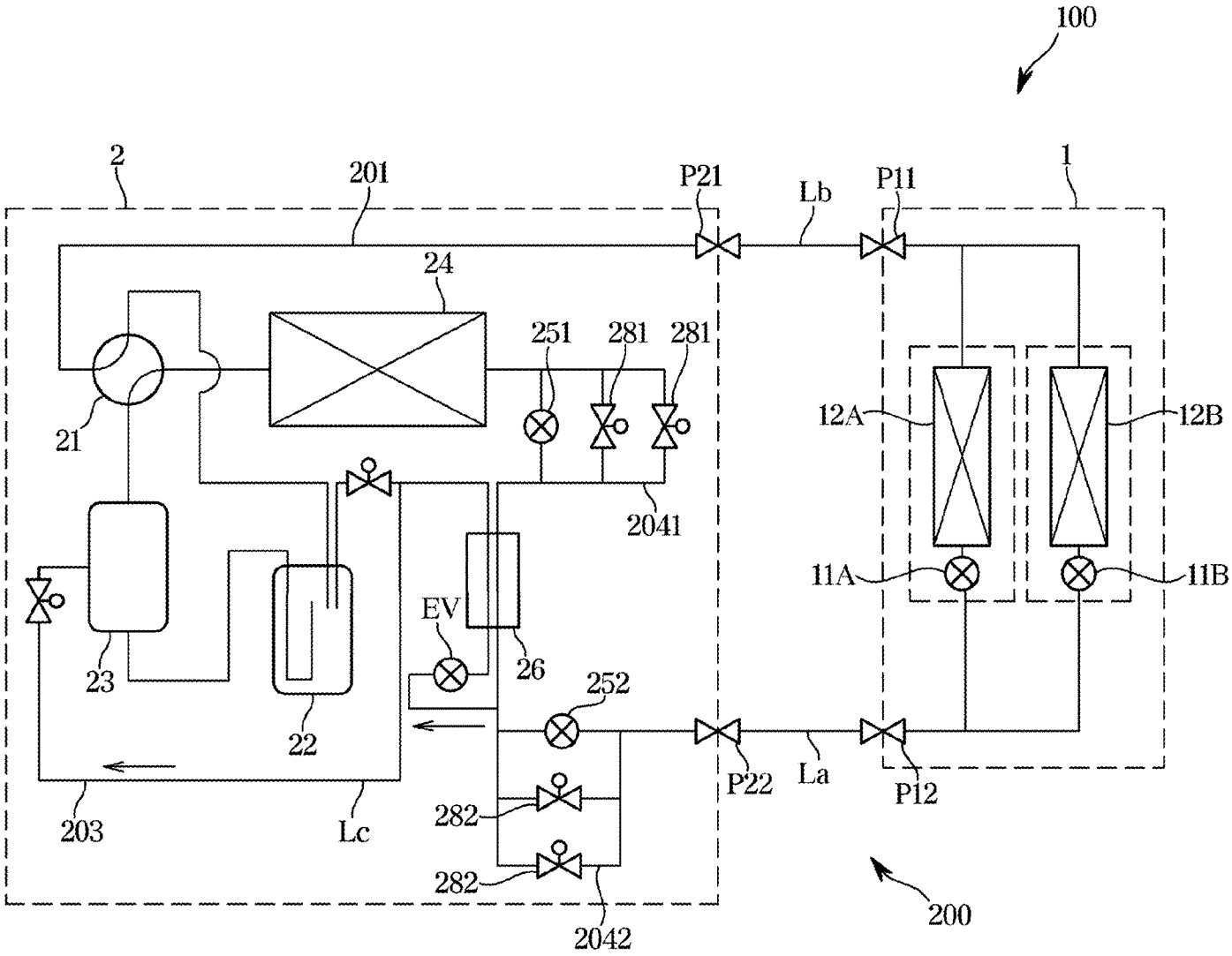
FIG. 4 illustrates a refrigerant circuit of an air conditioner according to a third embodiment of the disclosure.

FIG. 4 illustrates a refrigerant circuit of an air conditioner according to a third embodiment.

The air conditioner of the third embodiment may exclude the rectifier 27 of the first embodiment. The air conditioner of the third embodiment includes a first outdoor expansion valve 251 and a second outdoor expansion valve 252 sequentially installed on a refrigerant pipe directing to the indoor expansion valves 11A and 11B from the outdoor heat exchanger 24. The auxiliary heat exchanger 26 is provided on a refrigerant pipe between the first outdoor expansion valve 251 and the second outdoor expansion valve 252. Accordingly, the indoor expansion valves 11A and 11B, the indoor heat exchangers 12A and 12B, the four-way valves 21, the outdoor heat exchanger 24, the first outdoor expansion valve 251, the auxiliary heat exchanger 26, and the second outdoor expansion valve 252 may be connected on the main circuit 201 constituting the refrigerant circuit 200 in order.

A flow controller according to a third embodiment includes one or more first bypass passages 2041 bypassing the first outdoor expansion valve 251, one or more first flow regulating valves 281 installed on the one or more first bypass passages 2041, one or more second bypass passages 2042 bypassing the second outdoor expansion valve 252, and one or more second flow regulating valves 282 installed on the one or more second bypass passages 2042.

One end of the first bypass passage 2041 is connected to an upstream side of the first outdoor expansion valve 251 and the other end of the first bypass passage 2041 is connected to a downstream side of the first outdoor expansion valve 251. The first flow regulating valve 281 may be a motorized valve connected in parallel with the first outdoor expansion valve 251. One end of the second bypass passage 2042 is connected to an upstream side of the second outdoor expansion valve 252 and the other end of the second bypass passage 2042 is connected to a downstream side of the second outdoor expansion valve 252. The second flow regulating valve 282 may be a motorized valve connected in parallel with the second outdoor expansion valve 252.

The air conditioner of the third embodiment opens the first flow regulating valve 281 in the cooling operation. Accordingly, the refrigerant condensed in the outdoor heat exchanger 24 passes through the first outdoor expansion valve 251 and the first flow regulating valve 281 and then is cooled in the auxiliary heat exchanger 26. The refrigerant cooled in the auxiliary heat exchanger 26 becomes in a state where gas and liquid are mixed by being depressurized and expanded in the second outdoor expansion valve 252, and the gas-liquid mixed refrigerant flows to the indoor unit 1 through the refrigerant liquid pipe La. Because in the cooling operation the refrigerant passes through the first bypass passage 2041 connected in parallel with the first outdoor expansion valve 251 and then flows to the auxiliary heat exchanger 26, pressure loss of the refrigerant due to the resistance of the first outdoor expansion valve 251 may be reduced. Therefore, the lowering of the performance of the auxiliary heat exchanger 26 may be suppressed.

The air conditioner of the third embodiment opens the second flow regulating valve 282 in the heating operation. Accordingly, the refrigerant condensed in the indoor heat exchangers 12A and 12B passes through the second outdoor expansion valve 252 and the second flow regulating valve 282 and then is cooled in the auxiliary heat exchanger 26. The refrigerant passed through the auxiliary heat exchanger 26 is depressurized and expanded in the first outdoor expansion valve 251 and then flows to the outdoor heat exchanger 24. Because in the heating operation the refrigerant passes through the second bypass passage 2042 connected in parallel with the second outdoor expansion valve 252 and then flows to the auxiliary heat exchanger 26, pressure loss of the refrigerant due to the resistance of the second outdoor expansion valve 252 may be reduced, and thus, the lowering of the performance of the auxiliary heat exchanger 26 may be suppressed.

When proper heating degree control of the outdoor heat exchanger 24 is not possible in an opening degree range of the first outdoor expansion valve 251 in the heating operation, the air conditioner of the third embodiment may increase an opening degree of the flow regulating valve provided on the first bypass passage 2041 to reduce a flow rate of the refrigerant passing through the first outdoor expansion valve 251, thereby properly adjusting the heating degree in an outlet of the outdoor heat exchanger 24.

In the air conditioner of the third embodiment, at least one of the first flow regulating valves 281 provided on the first bypass passage 2041 may be replaced with a check valve allowing only a flow of the refrigerant from the outdoor heat exchanger 24 toward the auxiliary heat exchanger 26. In addition, in the air conditioner of the third embodiment, at least one of the second flow regulating valves 282 provided on the second bypass passage 2042 may be replaced with a check valve allowing only a flow of the refrigerant from the indoor heat exchangers 12A and 12B toward the auxiliary heat exchanger 26.

Figure 5:
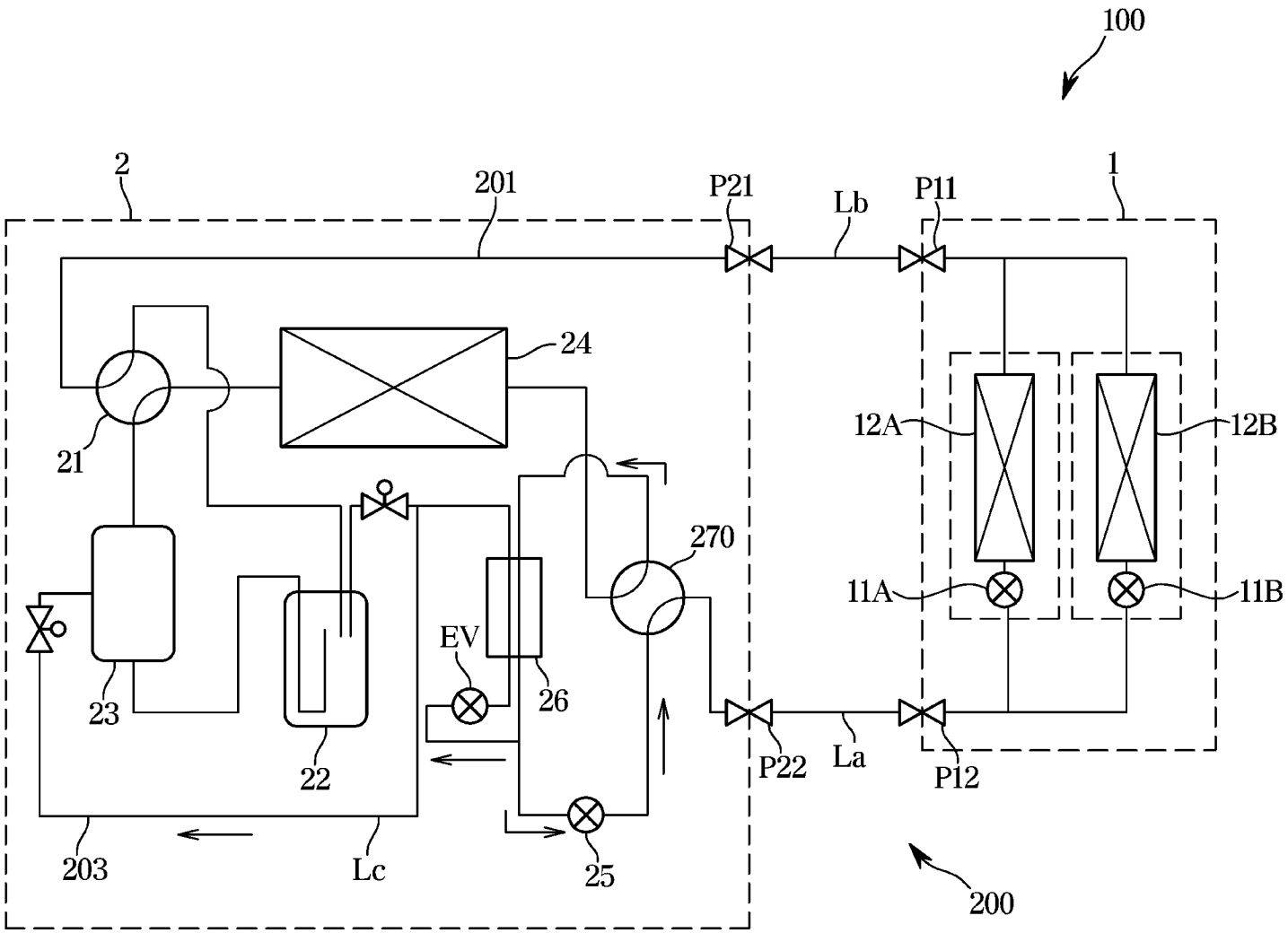
FIG. 5 illustrates a refrigerant circuit of an air conditioner according to a fourth embodiment of the disclosure.

FIG. 5 illustrates a refrigerant circuit of an air conditioner according to a fourth embodiment of the disclosure.

The air conditioner of the fourth embodiment includes a passage changer 270 as a passage controller capable of replacing the rectifier 27 of the first embodiment. The other configurations of the fourth embodiment are the same as those of the first embodiment.

The passage changer 270 may change passages such that the refrigerant flowing from the outdoor heat exchanger 24 toward the indoor expansion valves 11A and 11B in the cooling operation or the refrigerant flowing from the indoor expansion valves 11A and 11B toward the outdoor heat exchanger 24 in the heating operation sequentially passes through the auxiliary heat exchanger 26 and the outdoor expansion valve 25. The passage changer 270 may be a motorized type four-way valve changing the passages according to the switching of the cooling operation or the heating operation.

The passage changer 270 configured as a motorized type four-way valve may, in the cooling operation, allow the refrigerant passed through the outdoor expansion valve 25 to flow to the indoor expansion valves 11A and 11B and allow the refrigerant passed through the outdoor heat exchanger 24 to flow to the auxiliary heat exchanger 26. In addition, the passage changer 270 may, in the heating operation, allow the refrigerant passed through the indoor expansion valves 11A and 11B to flow to the auxiliary heat exchanger 26 and allow the refrigerant passed through the outdoor expansion valve 25 to flow to the outdoor heat exchanger 24.

As such, the passage changer 270 may perform substantially the same function as the rectifier 27 of the first embodiment. Therefore, like the air conditioner of the first embodiment, the air conditioner of the fourth embodiment may also reduce the amount of refrigerant flowing through the refrigerant circuit 200 and may prevent the operation efficiency from being lowered in both the cooling operation and the heating operation.

As is apparent from the above, an air conditioner according to an embodiment of the disclosure can reduce the amount of refrigerant flowing through a refrigerant circuit and prevent the performance of an auxiliary heat exchanger from being lowered in a cooling operation and a heating operation.

The air conditioner according to the disclosure is not limited to the above embodiments and may be variously modified without departing from the spirit thereof.

Although the present disclosure has been described with various embodiments, various changes and modifications may be suggested to one skilled in the art. It is intended that the present disclosure encompass such changes and modifications as fall within the scope of the appended claims.

What is claimed is:

1. An air conditioner comprising a refrigerant circuit, the refrigerant circuit including:

a compressor;

an outdoor heat exchanger;

an outdoor expansion valve;

an indoor expansion valve;

an indoor heat exchanger;

an auxiliary heat exchanger provided on a refrigerant pipe between the outdoor heat exchanger and the indoor expansion valve, the auxiliary heat exchanger connected in series with the outdoor expansion valve;

a rectifier configured to allow a refrigerant flowing from the outdoor heat exchanger toward the indoor expansion valve in a cooling operation and a refrigerant flowing from the indoor expansion valve toward the outdoor heat exchanger in a heating operation to sequentially flow through the auxiliary heat exchanger towards the outdoor expansion valve, an injection passage including one end connected to the compressor and the other end connected between the auxiliary heat exchanger and the outdoor expansion valve, and configured to allow a part of the refrigerant flowing from the auxiliary heat exchanger to the outdoor expansion valve to flow to the compressor through the auxiliary heat exchanger; and a supercooling expansion valve installed in the injection passage and configured to expand the refrigerant in the injection passage flowing toward the auxiliary heat exchanger.

2. The air conditioner according to claim 1, wherein a refrigerant flowing between the indoor expansion valve and the outdoor expansion valve is mixed in a gaseous state and a liquid state.

3. The air conditioner according to claim 1, wherein the rectifier, in the cooling operation, allows:

the refrigerant passed through the outdoor expansion valve to flow to the indoor expansion valve; and the refrigerant passed through the outdoor heat exchanger to flow to the auxiliary heat exchanger.

4. The air conditioner according to claim 1, wherein the rectifier, in the heating operation, allows:

the refrigerant passed through the indoor expansion valve to flow to the auxiliary heat exchanger; and the refrigerant passed through the outdoor expansion valve to flow to the outdoor heat exchanger.

5. The air conditioner according to claim 1, wherein the rectifier includes:

a first check valve to allow only a flow of the refrigerant from the indoor expansion valve toward the auxiliary heat exchanger in the heating operation;

a second check valve to allow only a flow of the refrigerant from the outdoor expansion valve toward the outdoor heat exchanger in the heating operation;

a third check valve to allow only a flow of the refrigerant from the outdoor heat exchanger toward the auxiliary heat exchanger in the cooling operation; and a fourth check valve to allow only a flow of the refrigerant from the outdoor expansion valve toward the indoor expansion valve in the cooling operation.

6. The air conditioner according to claim 1, further comprising:

at least one bypass passage bypassing the outdoor expansion valve; and at least one flow regulating valve installed on the at least one bypass passage.

7. An air conditioner comprising a refrigerant circuit, the refrigerant circuit including:

a compressor;

an outdoor heat exchanger;

an indoor expansion valve;

an indoor heat exchanger;

an outdoor expansion valve, the outdoor expansion valve including a first outdoor expansion valve and a second outdoor expansion valve, the first outdoor expansion valve and the second outdoor expansion valve sequentially installed on a refrigerant pipe from the outdoor heat exchanger toward the indoor expansion valve;

an auxiliary heat exchanger provided on a refrigerant pipe between the first outdoor expansion valve and the second outdoor expansion valve;

at least one first bypass passage bypassing the first outdoor expansion valve;

at least one first flow regulating valve installed on the at least one first bypass passage;

at least one second bypass passage bypassing the second outdoor expansion valve; and at least one second flow regulating valve installed on the at least one second bypass passage.

8. The air conditioner according to claim 7, wherein:

the first flow regulating valve is opened in a cooling operation; and the second flow regulating valve is opened in a heating operation.

9. The air conditioner according to claim 7, further comprising:

a check valve installed on the first bypass passage to allow only a flow of refrigerant from the outdoor heat exchanger toward the auxiliary heat exchanger; and a check valve installed on the second bypass passage to allow only a flow of refrigerant from the indoor heat exchanger toward the auxiliary heat exchanger.

10. The air conditioner according to claim 7, wherein refrigerant flowing between the second outdoor expansion valve and the indoor expansion valve is mixed in a gaseous state and a liquid state.

11. The air conditioner according to claim 7, further comprising an injection passage to allow a part of a refrigerant flowing from the auxiliary heat exchanger to the second outdoor expansion valve to flow to the compressor through the auxiliary heat exchanger.

12. The air conditioner according to claim 11, further comprising a supercooling expansion valve to expand the refrigerant in the injection passage flowing toward the auxiliary heat exchanger.

13. An air conditioner comprising a refrigerant circuit, the refrigerant circuit including:

a compressor;

an outdoor heat exchanger;

an outdoor expansion valve;

an indoor expansion valve;

an indoor heat exchanger;

an auxiliary heat exchanger provided on a refrigerant pipe between the outdoor heat exchanger and the indoor expansion valve, the auxiliary heat exchanger connected in series with the outdoor expansion valve;

a passage changer configured to change passages such that a refrigerant flowing from the outdoor heat exchanger toward the indoor expansion valve in a cooling operation and a refrigerant flowing from the indoor expansion valve toward the outdoor heat exchanger in a heating operation sequentially passes through the auxiliary heat exchanger towards the outdoor expansion valve, an injection passage including one end connected to the compressor and the other end connected between the auxiliary heat exchanger and the outdoor expansion valve, and configured to allow a part of the refrigerant flowing from the auxiliary heat exchanger to the outdoor expansion valve to flow to the compressor through the auxiliary heat exchanger; and a supercooling expansion valve installed in the injection passage and configured to expand the refrigerant in the injection passage flowing toward the auxiliary heat exchanger.

14. The air conditioner according to claim 13, wherein the passage changer includes a four-way valve.

15. The air conditioner according to claim 14, wherein the four-way valve, in the cooling operation, allows:

the refrigerant passed through the outdoor expansion valve to flow to the indoor expansion valve, and the refrigerant passed through the outdoor heat exchanger to flow to the auxiliary heat exchanger.

16. The air conditioner according to claim 14, wherein the four-way valve, in the heating operation, allows:

the refrigerant passed through the indoor expansion valve to flow to the auxiliary heat exchanger; and the refrigerant passed through the outdoor expansion valve to flow to the outdoor heat exchanger.

17. The air conditioner according to claim 13, wherein the refrigerant flowing between the indoor expansion valve and the outdoor expansion valve is mixed in a gaseous state and a liquid state.

* * * * *